US007065005B2

(12) United States Patent
Rochat

(10) Patent No.: US 7,065,005 B2
(45) Date of Patent: Jun. 20, 2006

(54) TIMEPIECE SUCH AS A WRISTWATCH INCLUDING AN ALARM MECHANISM

(75) Inventor: Marco Rochat, Le Brassus (CH)

(73) Assignee: Frédéric Piguet S.A., Le Brassus (CH)

( * ) Notice: Subject to any disclaimer, the term of this patent is extended or adjusted under 35 U.S.C. 154(b) by 285 days.

(21) Appl. No.: 10/648,635

(22) Filed: Aug. 27, 2003

(65) Prior Publication Data

US 2004/0042348 A1 Mar. 4, 2004

(30) Foreign Application Priority Data

Aug. 27, 2002 (EP) ..... 02078522

(51) Int. Cl.
*G04C 21/00* (2006.01)
*G04C 23/00* (2006.01)
*G04B 23/02* (2006.01)

(52) U.S. Cl. ..... 368/72; 368/250

(58) Field of Classification Search ..... 368/72–74, 368/80, 243, 244, 249, 250
See application file for complete search history.

(56) References Cited

U.S. PATENT DOCUMENTS 1,462,142 A * 7/1923 Lux ..... 368/74
1,483,768 A * 2/1924 Bickerton ..... 368/244
1,916,033 A * 6/1933 Baltsois ..... 368/249
2,063,884 A * 12/1936 Reinhardt ..... 368/249
2,223,243 A * 11/1940 Axelrod ..... 368/72
4,422,775 A 12/1983 Thoenig
6,134,190 A * 10/2000 Kotanagi ..... 368/74

FOREIGN PATENT DOCUMENTS

DE 42 13 780 A 10/1993
EP 0 075 535 A 3/1983
EP 0 836 125 A 4/1998
GB 309306 4/1929

OTHER PUBLICATIONS

Federation des Ecoles Techniques (Federation of Technical Schools) (Ed.) "Theorie de l'horlogerie", 10:Mecanismes de sonnerie. pp. 217-218.
European Search Report in corresponding EP 02 07 8522 completed May 9, 2003.

* cited by examiner

*Primary Examiner*—Ren Yan
*Assistant Examiner*—Leo T. Hinze
(74) *Attorney, Agent, or Firm*—Griffin & Szipl. P.C.

(57) ABSTRACT

Timepiece such as a wristwatch fitted with an alarm mechanism including a member able to produce an alarm signal at a predetermined moment, as well as a control device for providing visual information indicating whether the alarm mechanism is switched on or off, and simultaneously locking or releasing the alarm generator member, characterised in that the control device is activated by means of a push-button.

16 Claims, 3 Drawing Sheets

TIMEPIECE SUCH AS A WRISTWATCH INCLUDING AN ALARM MECHANISM

This application claims priority from European Patent Application No. 02078522.6, filed Aug. 27, 2002, the entire disclosure of which is incorporated herein by reference.

BACKGROUND OF THE INVENTION

The present invention concerns a timepiece, particularly a wristwatch, including an alarm mechanism able to produce an alarm signal at a predetermined moment.

Timepieces fitted with a device providing the user with visual information indicating whether the alarm is switched on or off, and simultaneously locking or releasing the strike-hammers of the alarm mechanism are already known. By way of example, British Patent No. GB 309 306, in the name of Schatz can be cited, which relates to such a type of timepiece. More precisely, the Schatz Patent discloses a timepiece of the alarm type including a lever of substantially triangular shape bearing, at its base, two inscriptions respectively indicating that the alarm of the timepiece is switched on or off. Depending on the position occupied by the lever, one or other of these inscriptions appears through an aperture arranged in the dial of the alarm clock. At its tip, the lever is pivotably mounted and includes a control button which projects outside the alarm clock case. By moving this button alternately in one direction or the other, the user can switch the striking-mechanism on and off as he wishes. Simultaneously, the lever locks or releases the strike-hammers of the alarm mechanism via a stopping member. Thus, depending upon the position into which the control button is moved, the alarm clock will provide the user with visual information indicating whether the alarm is switched on or not, and the strike-hammers of the alarm mechanism will be simultaneously locked or released.

A mechanism of the kind that has just been described, although suited to a timepiece of the alarm type, may however be difficult to adapt to a wristwatch. Indeed, the control button by means of which the state of the alarm can be adjusted, moves between two extreme positions along part of the circumference of the alarm clock. Mounted on the case of a wristwatch worn on a user's wrist, such a button could thus change position inadvertently, for example via the effect of a shock or by catching on the jacket sleeve of the person wearing it, such that said person would never reliably know the state of the alarm mechanism of his watch.

SUMMARY OF THE INVENTION

It is an object of the present invention to overcome this drawback in addition to others by providing a timepiece whose alarm mechanism can be switched on or off in a reliable manner and which simultaneously provides its user with visual information as to the state of said alarm mechanism.

The present invention therefore concerns a timepiece, in particular a wristwatch, fitted with an alarm mechanism including a member capable of producing an alarm signal at a predetermined moment, as well as a control device for providing visual information indicating whether the alarm mechanism is switched on or off, and for simultaneously locking or releasing the alarm generator member, characterised in that the control device is activated by means of a push-button.

As a result of these features, the present invention provides a timepiece wherein control of the display of the on or off state of the alarm mechanism and the locking, or respectively release of the alarm generator member are controlled by pressing on a push-button. According to the invention, the push-button may be of any type including, for example, a stem able to move by sliding against the return force of a spring inside a through hole arranged in the watchcase. By its very construction, such a push-button cannot be activated accidentally, such that the person wearing the watch according to the invention will always be able to know reliably the state (switched on or off) of the alarm mechanism of his watch. Likewise, the wearer is no longer liable to be inopportunely inconvenienced by the alarm mechanism unexpectedly going on or, conversely, missing a meeting or not waking up on time because the alarm mechanism has unintentionally been switched off.

According to another feature of the invention, the push-button acts on the control device via a column-wheel.

The column-wheel allows the control device to be activated with all the precision required for the visual information to be clearly perceptible to the user and the alarm generator member to be suitably immobilised. Moreover, a column-wheel is a simple mechanism whose operation is consequently reliable, and which, although allowing several functions to be simultaneously controlled, is nonetheless compact.

BRIEF DESCRIPTION OF THE DRAWINGS

Other features and advantages of the present invention will appear more clearly from the following detailed description of an embodiment of the timepiece according to the invention, this example being given solely by way of non-limiting illustration in conjunction with the annexed drawing, in which.

DETAILED DESCRIPTION OF THE PREFERRED EMBODIMENTS

The present invention proceeds from the general idea that consists in providing a simple device for alternately locking and unlocking an alarm mechanism in a reliable manner. The present invention thus teaches to activate a control device which simultaneously provides a visual indication as to the on or off state of the alarm mechanism and at the same time lock or release the alarm generator member by means of a push-button. As a result of this feature, the alarm mechanism is not liable to be unexpectedly activated, such that the user will always be able to trust the settings he has carried out on said alarm mechanism.

The present invention will be described in conjunction with a wristwatch. However, it goes without saying that the present invention is not limited to such a watch and that it can be applied to any type of timepiece.

Figure 1:
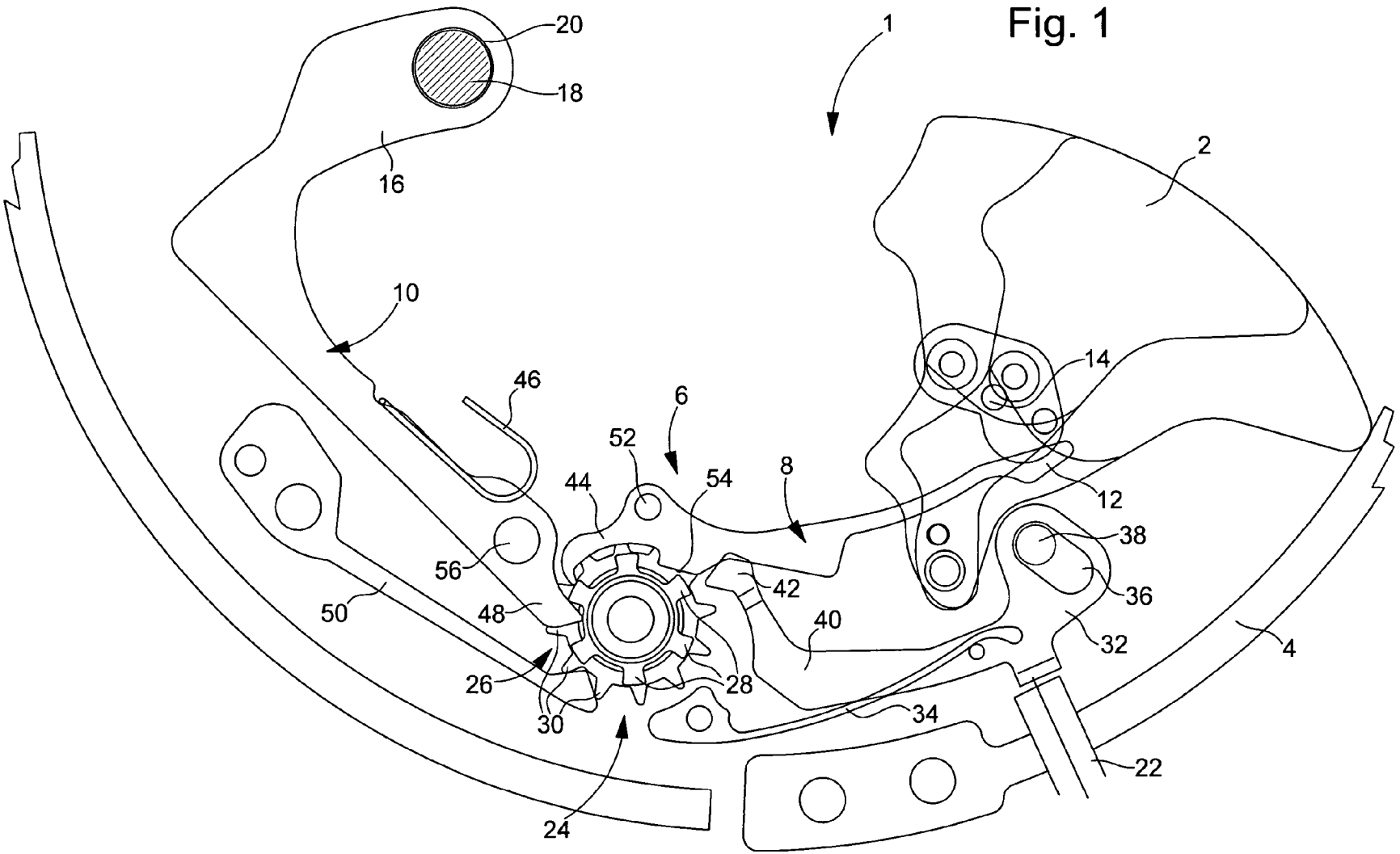
FIG. 1 is a plan view of the alarm mechanism in its unlocked position.

The alarm mechanism partially shown in FIG. 1, is, in its general construction, of a conventional type and includes the usual elements of mechanisms of this kind, namely, in particular, a striking-mechanism barrel which meshes with a striking-mechanism wheel and pinion set driving a hammer, this hammer striking a bell or a pin. An explanation of the operation of such a mechanism can be found, for example in the collective work entitled "Théorie de l'horlogerie" edited by the Federation of Technical Schools (Fédération des Ecoles Techniques) (Switzerland).

Designated as a whole by the general reference numeral 1, the alarm mechanism includes a member 2 able to produce an alarm signal at a predetermined moment preselected by the person wearing the watch. In the example shown in the drawing, this alarm generator member 2 takes the form of a strike-hammer striking a gong 4. Of course, alarm generator member 2, instead of producing an audible alarm signal, could generate a silent alarm, for example a vibration that the user can feel when he is wearing the watch on his wrist.

The wristwatch according to the invention also includes a control device 6 that has a dual role. On the one hand, it provides the user with visual information in order to indicate whether the alarm mechanism is switched on or off, and, on the other hand, simultaneously locks or releases the strike-hammer 2. Control device 6 includes, for this purpose, an alarm locking lever 8 and a locking indicator lever 10. As will be seen in more detail in the following description, alarm locking lever 8 includes an arm 12 which, in the locked position of alarm mechanism 1, immobilises strike-hammer 2 by pressing against a stop member 14, such as a pin secured to said hammer 2. Locking indicator lever 10 has, at one of its ends, a bent shape 16, which bears a display symbol 18 such as a coloured disc formed by a transfer added to said locking indicator lever 10. This coloured disc 18 is intended to appear facing an aperture 20 (see FIG. 2) arranged in the watch dial to indicate to the user that alarm mechanism 1 is switched on.

According to the invention, the user can activate control device 6 when he wishes from the outside of the watchcase via a push-button 22. This push-button 22, shown schematically in the drawing, can be of any type desired, provided that by pushing it with a finger, it can act on control device 6, then return to its initial position when the pressure ceases.

Push-button 22 acts on control device 6 via a column-wheel 24. This column-wheel 24 is formed of a toothing 26 called a ratchet and columns 28 made perpendicular to toothing 26. As alarm mechanism 1 according to the invention is a two-time mechanism, the number of teeth 30 of ratchet 26 is double the number of columns 28. As shown in the drawing, teeth 30 of ratchet wheel 26 are twelve in number, and columns 28 are six in number. It goes without saying, however, that these numbers are given by way of example only, and that they could be different, provided that the number of teeth 30 of ratchet wheel 26 is two times more than the number of columns 28.

As will now be described in detail, columns 28 of wheel 24 create teeth and spaces for controlling the movements of the levers, namely alarm locking lever 8 and locking indicator lever 10, which abut against a column 28 or are located between two columns 28.

The rectilinear movement along arrow A of push-button 22 is transformed into a pivoting movement by an alarm stopping control lever 32 on which push-button 22 abuts. Control lever 32, biased by a spring 34, has at one of its ends an oblong hole 36 into which a shaft 38 projects, and a bent shape 40 ending in a beak 42 located between two teeth 30 of ratchet wheel 26 at its other end. When there is a first application of pressure on push-button 22, alarm mechanism 1 according to the invention is in the situation shown in FIG. 1, state in which said alarm mechanism 1 is not locked, which means that strike-hammer 2 can strike gong 4 at the moment when the alarm time programmed by the user is reached. Arm 12 of alarm locking lever 8 is thus moved away from pin 14 of hammer 2, whereas at the opposite end to said arm 12, alarm locking lever 8 is abutting, via a beak 44, one of columns 28 of wheel 24. At the same time, locking indicator lever 10, biased by a spring 46, is meshed with column-wheel 24 via a beak 48, which is located between two columns 28. In this position of locking indicator lever 10, coloured disc 18 is visible through aperture 20 made in the watch dial, which indicates to the user that alarm mechanism 1 of his watch is in the active position.

Figure 2:
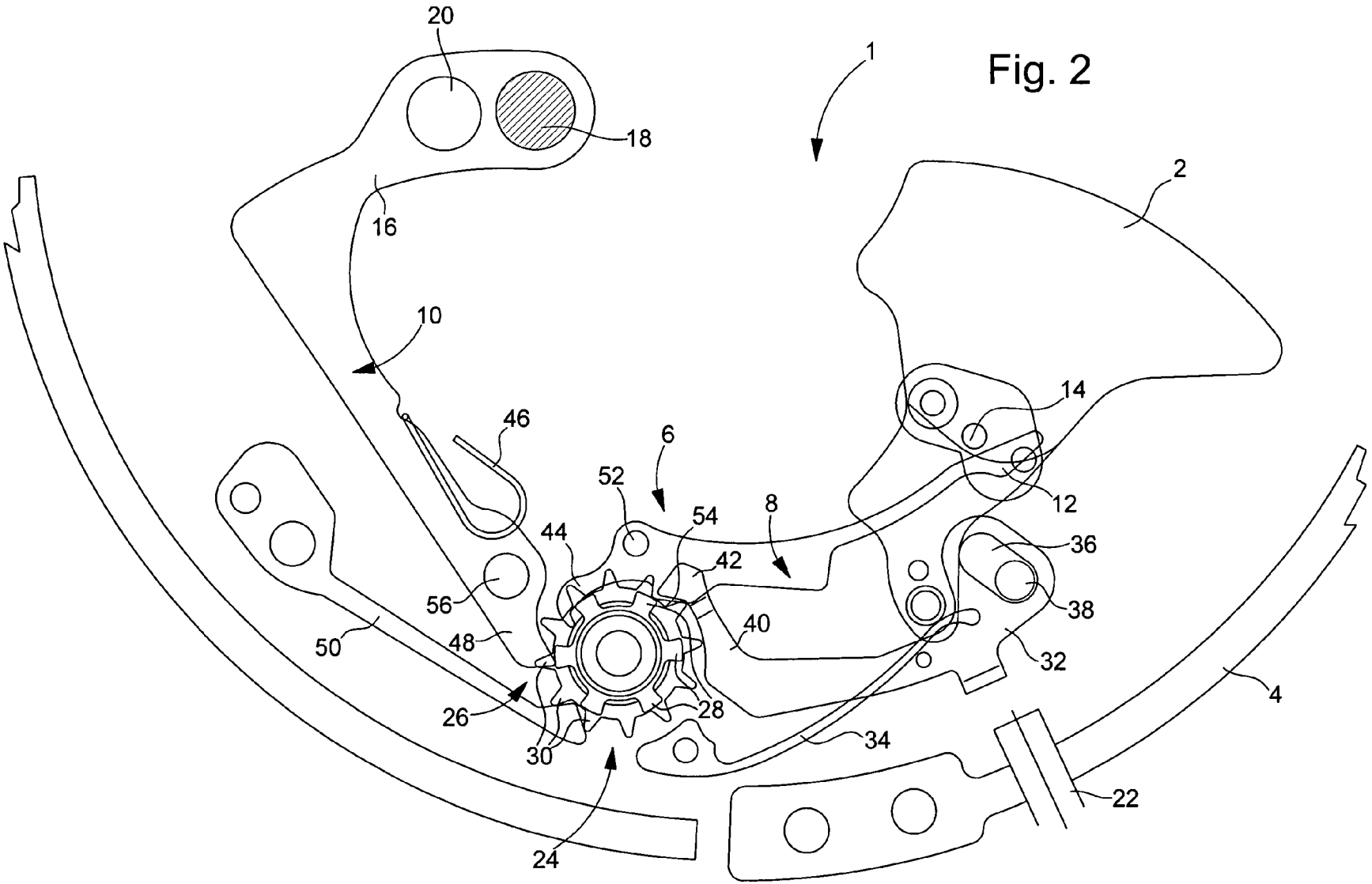
FIG. 2 is a similar view to that of FIG. 1, the alarm mechanism being shown in its locked position.
Figure 3:
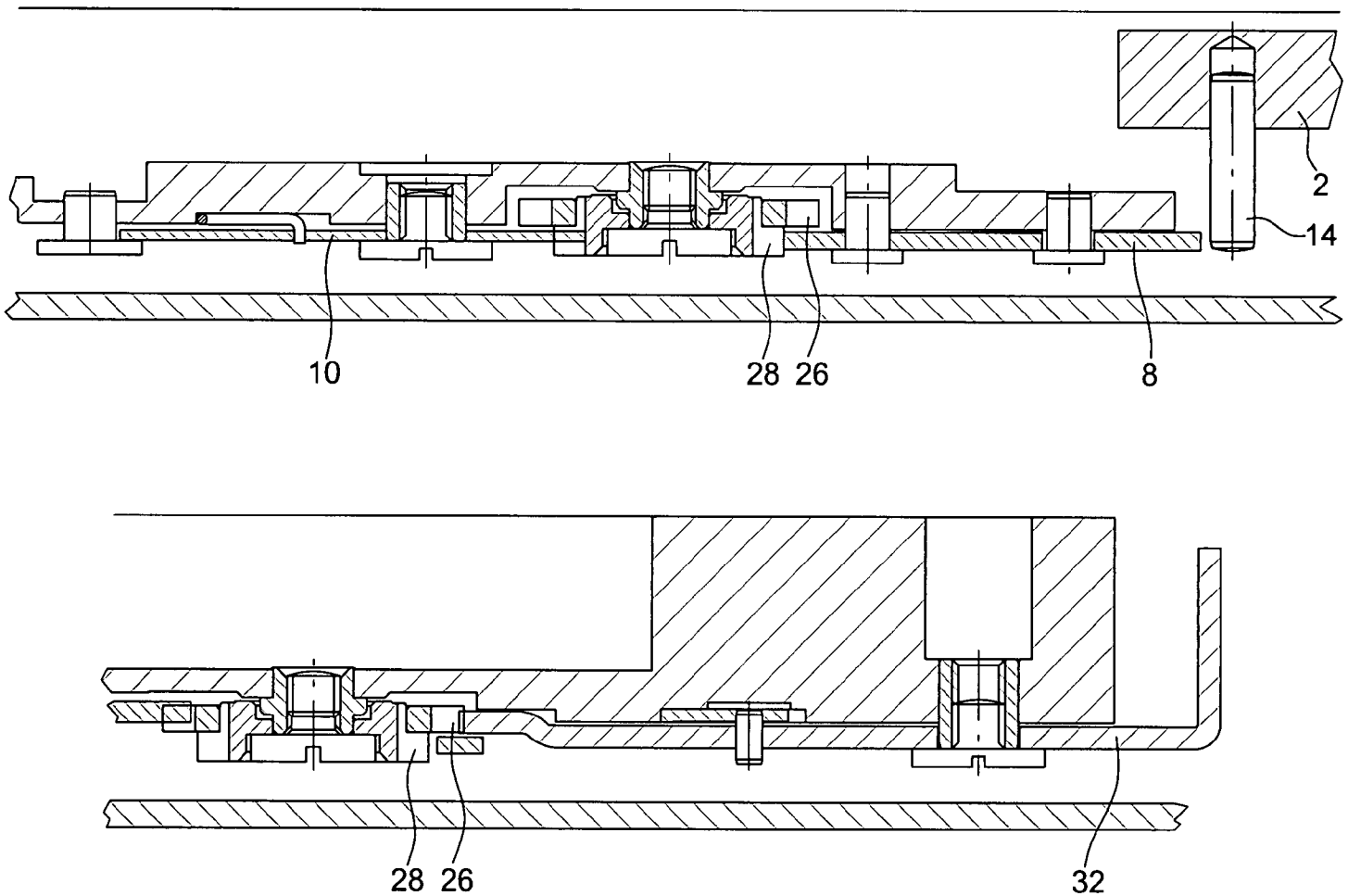
FIG. 3 is a cross-section of the alarm mechanism shown in FIGS. 1 and 2.

A subsequent application of pressure on push-button 22 causes control lever 42 to pivot, which drives via its beak 42 column-wheel 24 into a rotational movement of a twelfth of a revolution in the anti-clockwise direction (FIG. 2). Column-wheel 24 is immobilised in this new position by a jumper spring 50, i.e. a spring ending in two inclined planes that rest between the points of two consecutive teeth 30 of ratchet wheel 26 to hold it in position. When said ratchet wheel 26 is activated, its teeth 30 lift jumper spring 50, which then falls between two other teeth.

During the rotational movement of column-wheel 24, beak 44 of alarm locking lever 8, which was previously abutting one of columns 28, falls between two of these columns 28, which has the effect of causing alarm locking lever 8 to pivot upwards about a shaft 52, such that its arm 12 prevents the travel of pin 14 and immobilises hammer 2 to which said pin 14 is secured. In order to ensure that alarm locking lever 8 is held securely and thus that hammer 2 is perfectly still, said alarm locking lever 8 has a heel 54 arranged such that, when beak 44 falls between two columns 28, this heel 54 abuts against another of columns 28. At the same time that alarm locking lever 8 immobilises strike-hammer 2, locking indicator lever 10 is also driven by column-wheel 24 into a pivoting movement about shaft 56. Beak 48 of said locking indicator lever 10 which was previously located between two columns 28 of wheel 24 is lifted by one of columns 28 and abuts against it. During this movement, coloured disc 18, which symbolises the switched-on state of alarm mechanism 1 is removed and it is a part of bent shape 16 of locking indicator lever 10 which appears in aperture 20 arranged in the watch dial. One can, for example, imagine that coloured disc 18 is red, whereas the rest of bent shape 16 is white. Thus, when the user sees a disc that is white or the same colour as that of the dial through aperture 20 of his watch dial, he will know that alarm mechanism 1 according to the invention is locked and that the alarm is thus inhibited.

When there is a new application of pressure on push-button 22, alarm mechanism 1 returns to the situation illustrated in FIG. 1. Activated by push-button 22, control lever 32 pivots and drives, via its beak 42, the column-wheel, which makes a rotational movement of a twelfth of a revolution. During this movement, beak 44 of alarm locking lever 8, which was located between two columns 28 is lifted by one of its columns and abuts against it. Consequently, lock 8 pivots about its shaft 52 and its arm 12 is moved away from pin 14, thus releasing hammer 2. At the same time, beak 48 of locking indicator lever 10, which was abutting a column 28 falls between two of these columns 28, which causes said indicator lever 10 to pivot about its shaft 56 and coloured disc 18 to appear in aperture 20 made in the watch dial, thus indicating to the user that alarm mechanism 1 is released and that the alarm is thus switched on.

It goes without saying that the present invention is not limited to the embodiment that has just been described, and that various simple modifications and variants can be envisaged without departing from the scope of the invention.

What is claimed is:

1. A timepiece fitted with an alarm mechanism including a member able to produce an alarm signal at a predetermined moment, as well as a control device for providing visual information indicating whether the alarm mechanism is switched on or off, and simultaneously locking or releasing the alarm generator member, wherein the control device is activated by means of a push-button that acts on the control device via a column-wheel.

2. The timepiece according to claim 1, wherein the control device includes an alarm locking lever and a locking indicator lever.

3. The timepiece according to claim 2, wherein the locking indicator member bears a display symbol intended to appear facing an aperture arranged in a dial of the timepiece to indicate that the alarm mechanism is switched on, and includes a beak which can abut against a column of the column-wheel or be situated between two columns of the column-wheel.

4. The timepiece according to claim 2, wherein the column-wheel is formed of a ratchet wheel provided with teeth and columns made perpendicular to the ratchet wheel and the alarm locking lever includes an arm which, in the locked position of the alarm mechanism, immobilises the alarm generator member, and a beak, which can abut against a column of the column-wheel or be situated between two columns of the column-wheel.

5. The timepiece according to claim 4, wherein the arm of the alarm locking lever immobilises the alarm generator member by abutting against a stop member secured to said alarm generator member.

6. The timepiece according to claim 4, wherein the locking indicator member bears a display symbol intended to appear facing an aperture arranged in a dial of the timepiece to indicate that the alarm mechanism is switched on, and includes a beak which can abut against a column of the column-wheel or be situated between two of columns of the column-wheel.

7. The timepiece according to claim 4, wherein the alarm locking lever includes a heel which, when the beak falls between two columns, abuts against another of said columns.

8. The timepiece according to claim 7, wherein the arm of the alarm locking lever immobilises the alarm generator member by abutting against a stop member secured to said alarm generator member.

9. The timepiece according to claim 7, wherein the stop member is a pin.

10. The timepiece according to claim 1, wherein the alarm generator member is formed by a hammer able to strike a gong.

11. The timepiece according to claim 1, wherein the alarm generator member generates a silent alarm.

12. The timepiece according to claim 1, wherein the timepiece is a wristwatch.

13. The timepiece according to claim 1, wherein the column-wheel is disposed to control movements of an alarm locking lever and a locking indicator lever.

14. A timepiece fitted with an alarm mechanism including a member able to produce an alarm signal at a predetermined moment, as well as a control device for providing visual information indicating whether the alarm mechanism is switched on or off, and simultaneously locking or releasing the alarm generator member, wherein the control device is activated by means of a push-button that acts on the control device via a column-wheel, wherein the column-wheel is formed of a ratchet wheel provided with teeth and columns made perpendicular to the ratchet wheel, the number of teeth of the ratchet wheel being double the number of the columns.

15. The timepiece according to claim 14, wherein the push-button acts on the column-wheel via a control lever.

16. The timepiece according to claim 14, wherein the timepiece is a wristwatch.

* * * * *